United States Patent [19]

Hashizume et al.

[11] 4,411,666

[45] Oct. 25, 1983

[54] PROCESS FOR DYEING POLYOLEFIN FIBER MATERIALS

[75] Inventors: Shuhei Hashizume, Settsu; Sadaharu Abeta, Toyonaka; Tadayuki Ohmae; Hajime Nishibara, both of Niihama, all of Japan

[73] Assignee: Sumitomo Chemical Company, Limited, Osaka, Japan

[21] Appl. No.: 346,537

[22] Filed: Feb. 8, 1982

Related U.S. Application Data

[63] Continuation-in-part of Ser. No. 255,841, Apr. 20, 1981, abandoned.

[30] Foreign Application Priority Data

Apr. 25, 1980 [JP] Japan ..... 55-55690
Feb. 6, 1981 [JP] Japan ..... 56-17242

[51] Int. Cl.[3] ..... D06P 1/653; D06P 1/39; D06P 3/85

[52] U.S. Cl. ..... 8/455; 8/531; 8/540; 8/580; 8/594

[58] Field of Search ..... 8/455, 531, 540, 580, 8/594

[56] References Cited

U.S. PATENT DOCUMENTS

| | | | |
|---|---|---|---|
| 3,184,281 | 5/1965 | Tsunoda et al. | 8/594 |
| 3,316,054 | 4/1967 | Tsunoda et al. | 8/594 |
| 3,395,198 | 7/1968 | Taniguchi et al. | 8/540 |
| 3,653,803 | 4/1972 | Hammer | 8/540 |
| 3,663,157 | 5/1972 | Gilgien et al. | 8/455 |
| 3,702,229 | 11/1972 | Campana | 8/594 |
| 3,744,968 | 7/1973 | Fuest | 8/540 |

FOREIGN PATENT DOCUMENTS

| | | | |
|---|---|---|---|
| 764286 | 8/1971 | Belgium | 8/594 |
| 45-5065 | 2/1970 | Japan | 8/928 |
| 49-24190 | 6/1974 | Japan | 8/928 |
| 1252747 | 11/1971 | United Kingdom | 8/580 |

*Primary Examiner*—Maria Parrish Tungol
*Attorney, Agent, or Firm*—Stevens, Davis, Miller & Mosher

[57] ABSTRACT

A process for dyeing polyolefin fiber materials, which comprises contacting a polyolefin fiber material obtained by melt-spinning a mixture of crystalline polyolefin and 0.1 to 30% by weight based on the weight of the polyolefin of a copolymer of ethylene and an aminoalkyl acrylate compound represented by the formula,

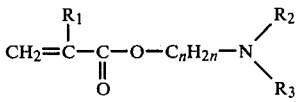

wherein $R_1$ represents hydrogen atom or methyl group, $R_2$ and $R_3$ each represents hydrogen atom or an alkyl group having 1 to 4 carbon atoms, and n represents an integer from 1 to 4, or a blend product of the said polyolefin fiber material and a polyamide fiber material, with a dye bath containing an anionic dye and at least one carboxylic acid selected from the group consisting of benzoic acid, salicylic acid, p-chlorobenzoic acid and 5-chlorosalicylic acid.

7 Claims, No Drawings

PROCESS FOR DYEING POLYOLEFIN FIBER MATERIALS

This application is a continuation-in-part application of the application, Ser. No. 255,841, filed Apr. 20, 1981, now abandoned.

This invention relates to a process for dyeing a polyolefin fiber material modified by the incorporation of a basic substance or a blend product comprising said polyolefin fiber material and a polyamide fiber material.

Polyolefins have favorable physical and mechanical characteristics such as, for example, high strength, low specific gravity and excellent antistatic property which is most pronounced of all synthetic fibers in preventing the accumulation of an electric charge. In addition, they are available at low cost. For these reasons, they are expected to extend their uses in the field of furnishings such as carpets, upholsteries, and the like. However, because of the hydrophobicity and chemical inertness characteristic of polyolefins, the polyolefin fibers are difficult to dye by customary methods and in current practice they are colored mostly by dope dyeing.

Various attempts have heretofore been made to improve the insufficient affinity of polyolefins for dyes. Among various proposals those methods in which a polyolefin is incorporated with a substance capable of providing a dyeing site for anionic dyes are promising in view of the retention of good spinnability and high strength characteristic of polyolefins. A dyeable polyolefin composition which seems to be especially promising from the industrial viewpoint is one comprising a crystalline polyolefin incorporated with 0.1 to 30% by weight based on the polyolefin of a copolymer of ethylene and an aminoalkyl acrylate, as disclosed in Japanese Patent Publication No. 22,523/1967. Such a polyolefin composition, however, embraces contradictory tendencies such that if the proportion of said basic copolymer is increased to further improve the dyeability, the physical properties of the resulting polyolefin fiber will be injured, while if the proportion is decreased, the affinity for anionic dyes will be decreased. For this reason, the dyeing affinity for anionic dyes cannot be made sufficiently high and further improvement is still desired.

To overcome the above difficulties, attempts have, heretofore, been made to treat a polyolefin fiber with a dye carrier compound after or before the commencement of dyeing operation. For instance, Japanese Patent Publication No. 23,910/1969 proposed the use of at least one of the halogen-substituted aromatic compounds, derivatives of aromatic carboxylic acids, and alkylnaphthalenes as the carrier; and Japanese Patent Publication Nos. 30,028/1969 and 5,065/1970 disclosed a method employing an emulsion of a higher aliphatic alcohol. These methods have disadvantages because the use of a carrier causes the retention of some odor and higher aliphatic alcohols offers only insufficient affinity for dyes.

In the field of interior furnishings, particularly as a floor covering material, natural and synthetic polyamide textiles such as wool, polycapramide (nylon 6) and polyhexamethylene adipamide (nylon 66) have played a leading role world-wide because of their excellent elastic recovery, favorable handling touch, and desirable affinity for dyes. Carpets and other floor coverings now enterring the market are made of blend products such as fiber blends, twisted union yarns, and knitted union fabrics comprising polyolefin fiber and polyamide fiber.

These blend products cover up mutual defects by taking advantage of mutual characteristics and create a novel hand touch. In manufacturing such a carpet, each fiber material is individually loose fiber or yarn-dyed and then blended together and tufted. Although having been put into practice to a limited extent, this method of operation is hardly adaptable to the production of a large variety of goods in small lots, which is needed to meet the demand of the market.

In order to solve the above problems, it is desirous to color both polyolefin and polyamide fibers in the same shade from the same dyebath containing the dyes of the same family. Unfortunately, however, owing to the difference between the modes of dyeing both types of fibers, it has been difficult to realize the solid dyeing.

As is well known, the polyamide fiber is a fiber highly receptive to anionic dyes under acidic conditions, whereas the dyeing of polyolefin fiber brings about difficult problems as described above.

Under the circumstances, the present inventors carried out extensive investigations in search of an industrially practicable method of dyeing a polyolefin textile material or a blend product thereof with a polyamide textile material. As a result, it was found that the above-mentioned problems may be solved by carrying out a novel dyeing procedure employing specific dyeing auxiliaries.

This invention provides a process for dyeing polyolefin fiber materials, which comprises contacting a polyolefin fiber material obtained by melt-spinning a mixture of crystalline polyolefin and 0.1 to 30% by weight based on the weight of the polyolefin of a copolymer of ethylene and an aminoalkyl acrylate compound represented by the formula,

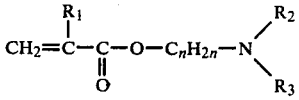

(I)

wherein $R_1$ represents hydrogen atom or methyl group, $R_2$ and $R_3$ each represents hydrogen atom or an alkyl group having 1 to 4 carbon atoms, and n represents an integer from 1 to 4, or a blend product of the said polyolefin fiber material and a polyamide fiber material, with a dye bath containing an anionic dye and at least one carboxylic acid, selected from the group consisting of benzoic acid, p-chlorobenzoic acid, salicylic acid and 5-chlorosalicylic acid.

The characteristic features of the method of this invention include: a marked improvement in the affinity of materials for dyes by the use of the specified carboxylic acid in place of or jointly with an acid customarily used in a conventional dyeing method, whereby the problem associated with the odor of a conventional carrier can be solved; adaptability of the method to exhaust-dyeing, continuous dyeing, and printing; and an improvement in the color fastness of the dyed goods to wetting, rubbing, and light. The method of this invention, moreover, is characterized by rendering the blend product comprising a polyolefin fiber and a polyamide fiber submissive to solid dyeing in a single bath, resulting in dyed goods having an excellent color fastness to wetting, rubbing and light.

The process of the invention is further illustrated below in detail.

The polyolefin fiber material to be dyed by the present method is that obtained by incorporating into a crystalline polyolefin 0.1 to 30% by weight based on the weight of the polyolefin of a copolymer of ethylene and an aminoalkyl acrylate compound represented by the formula (I) and then melt-spinning the resulting mixture, and, if necessary, followed by drawing and crimping.

The aminoalkyl acrylate compounds of the formula (I) suitable for the purpose include various compounds as described in Japanese Patent Publication No. 22,523/1967. Especially preferred are dimethylaminoethyl methacrylate, diethylaminoethyl methacrylate and dimethylaminoethyl acrylate.

The copolymer may be obtained by bringing ethylene and the aminoalkyl acrylate compound of the formula (I) into mutual contact in the presence of a free radical catalyst such as oxygen, an organic peroxide or a diazo compound under an ethylene pressure of 500 to 4,000 kg/cm$^2$ at 40° to 300° C. It is generally produced on a commercial scale by the continuous polymerization of ethylene and the comonomer of the formula (I) while keeping the comonomer content of the feed below 20%. A copolymer produced by the batch operation is also suitable. A copolymer containing 1 to 50 mole-% of the aminoalkyl acrylate compound and having a melt index of 1 to 1000 is preferred.

The polyolefin fiber material may contain various additives such as a stabilizer, antioxidant, ultraviolet absorber, and so on. It is also desirable to improve the spinning property and dyeing affinity by incorporating metal salts of various organic carboxylic acids into the material. Examples of suitable salts include sodium or potassium salts of benzoic acid, p-tert-butylbenzoic acid, phenylacetic acid, mellitic acid, 1,8-naphthoic acid, stearic acid, lauric acid, oleic acid, palmitic acid, and o-phthalic acid. Of these salts, sodium salt of a higher fatty acid such as sodium stearate is preferred.

Another type of textile material to be dyed by the present method is a blend product comprising the above-noted polypropylene fiber material and a polyamide fiber material. The suitable polyamide fibers include nylon fibers and wool, the former including fibers made from polymerized ε-caprolactam and those made from poly(hexamethyleneadipamide), a polymer obtained by the reaction between adipic acid and hexamethylenediamine. The form of the blend product comprising the polyolefin fiber and the polyamide fiber may be a blended yarn, a twisted union yarn, and woven or knitted union fabric. In such products, the blending ratio is optional.

The carboxylic acids suitable for use in the present method include benzoic acid, salicylic acid, 5-chlorosalicylic acid, p-chlorobenzoic acid, and a mixture thereof. Among them, salicylic acid is preferred from the industrial point of view, because favorable results can be achieved irrespective of the kinds of anionic dyes used. Such carboxylic acids may be in the form of mixed acids containing the carboxylic acid liberated on adding an equivalent amount or more of a water-soluble inorganic or organic acid such as sulfuric acid, phosphoric acid, or formic acid to an alkali metal salt of the above carboxylic acids. The amount added of these acids added to the carboxylic acid is generally 0.1 to 30%, preferably 0.3 to 20%, by weight based on the weight of the material to be dyed.

The dyeing of a modified polypropylene fiber material with an anionic dye according to this invention may be carried out by an exhaustion dyeing method using a dye bath containing the above-noted carboxylic acid, if necessary, in the form of an emulsion prepared by use of a nonionic surface active agent. Alternatively, a continuous dyeing method can be used comprising the steps of passing the fiber material through a padding bath containing said carboxylic acid or an emulsion thereof and subjecting the material padded to fixing treatment and steaming.

In the printing method, the material to be dyed is printed with a color paste prepared by adding an emulsion of the carboxlic acid to a printing paste, and then fixed (usually by steaming).

When it is desired to disperse or emulsify the carboxylic acid, it is effective to use a noiionic surface active agent such as, for example, an alkyl- or aryl-ether or -ester of polyethylene glycol (HLB value=5–15). A homogeneous solution may also be obtained by the dissolution in a lower alcohol and can be used without any disadvantage.

It is also advantageous from viewpoint of dyeing operation to use a mixture obtained by adding an equivalent amount or more of an inorganic or organic acid such as sulfuric acid, phosphoric acid or formic acid to a solution containing a water-soluble alkali metal salt of the above-mentioned carboxylic acid to liberate the latter carboxylic acid.

The penetrating and level-dyeing properties of dyes can be further improved by adding to the bath a penetrant or levelling agent such as, for example, an alkanolamide of a higher aliphatic or aromatic carboxylic acid or a nonionic surface active agent of the polyoxyethylene type.

The test results of the present dyeing method are compared with those of a conventional method as tabulated below.

Materials to be dyed: Yarn of 15 denier and knitted fabric made from the yarn, the yarn being produced by spinning at 260° C. a blend of polypropylene and ethylene-dimethylaminoethyl-methacrylate copolymer (dimethylaminoethyl-methacrylate content: 30% by weight, melt index: 400) in a weight ratio of 93:7, and then drawing it three-fold at 100° C.

Dye: C.I. Acid Blue 129.

| | Percentage of fixed dye, % | | Color fastness to light, JIS L0842 (63° C. × 40 hr.), rating | |
|---|---|---|---|---|
| | Tartaric acid (conventional) | Salicylic acid (this invention) | Tartaric acid (conventional) | Salicylic acid (this invention) |
| Exhaust dyeing | 49 (62) | 90 (99.7) | 4 | 6 |
| Continuous dyeing | 45 | 84 | 3 | 5–6 |

-continued

| | Percentage of fixed dye, % | | Color fastness to light, JIS L0842 (63° C. × 40 hr.), rating | |
|---|---|---|---|---|
| | Tartaric acid (conventional) | Salicylic acid (this invention) | Tartaric acid (conventional) | Salicylic acid (this invention) |
| Printing | 40 | 80 | 3 | 5–6 |

Note:
Figures in parentheses show the percentage of exhaustion.

| Color fastness (JIS testing method) | Dip dyeing, rating | | | | | |
|---|---|---|---|---|---|---|
| | Tartaric acid (conventional) | | | Salicylic acid (this invention) | | |
| To light (L-0842; 63° C. × 40 hour) | 4 | | | 6 | | |
| | Color change | Staining on nylon | Staining on viscose | Color change | Staining on nylon | Staining on viscose |
| To water (L-0846) | 4 | 1–2 | 5 | 4 | 3 | 5 |
| To washing (L-0844) | 3–4 | 3 | 5 | 4 | 4–5 | 5 |
| | Dry | | Wet | Dry | | Wet |
| To rubbing (L-0849) | 4 | | 3 | 4–5 | | 4 |

As shown in the above tables, as compared with tartaric acid used in conventional dyeing procedures, salicylic acid is far better in percentage of fixed dye and color fastness.

The dyeing of blend products of polypropylene fiber and polyamide fiber is carried out at pH 5 or below in the presence of a resist agent for the polyamide fiber in addition to at least one carboxylic acid mentioned above. The suitable resist agents for the polyamide fiber are derivatives of aromatic sulfonic acids including alkali metal or ammonium salts of benzenesulfonic acid which may be substituted with an alkyl group having 8 to 17 carbon atoms and/or a hydroxyl group; alkali metal or ammonium salts of naphthalenesulfonic acids which may be substituted with an alkyl group having 1 to 12 carbon atoms and/or a hydroxyl group; mixtures of these sulfonic acid salts; condensation products of these sulfonic acid salts with formaldehyde; and condensation products of formaldehyde with a mixture of a bisphenolsulfone and an alkali metal or ammonium salt of a naphthalenesulfonic acid. Although depending on the dyeing depth and the blending ratio of polypropylene fiber and polyamide fiber in the blend product the amount to be used of a resist agent is generally 0.1 to 20%, preferably 0.2 to 15%, based on the weight of the material to be dyed.

In the dyeing of the blend products in this invention, the pH of the bath is 5 or below, preferably 2.5 to 3.5. If the pH exceeds 5, the dyeing affinity of anionic dyes for the polyolefin fiber will decline so that the solid dyeing of the blend product becomes difficult. The adjustment of pH of the bath is performed by the addition of the above-said carboxylic acid alone or, if necessary, jointly with an acid customarily used in dyeing such as sulfuric acid, phosphoric acid, formic acid, acetic acid or tartaric acid. A most practical precedure is to add to the bath an alkali metal salt of said carboxylic acid followed by a customary acid to adjust the pH to a required level.

The solid dyeing of a blended material of polypropylene fiber and polyamide fiber with an anionic dye according to this invention is carried out by the exhaustion dyeing method or the continuous dyeing method involving padding and steaming steps.

In preparing the bath for exhaustion dyeing or for padding, the carboxylic acid is added in the form of an emulsion containing a dispersant, or as a solution in a small amount of a water-soluble organic solvent. Another practical procedure is to add to the bath at first an aqueous solution of an alkali metal salt of the carboxylic acid and, before the commencement of dyeing, to add an equivalent amount or more of a customary acid such as sulfuric acid, phosphoric acid, or formic acid to liberate the carboxylic acid. For further promoting the penetration of dyes into the dyeing material and for assisting the level dyeing, it is advisable to add to the bath penetrants, levelling agents, solubilizing or dispersing agents for dyes, and the like.

The carboxylic acid and if desired, other additives including the resist agent for the polyamide fiber may be added to a dye to form a dye composition. That is, the manner of adding these additives is not particularly limited.

The anionic dyes for use in the present method include acid dyes, metal complex acid dyes, direct dyes, and acid mordant dyes. In dyeing the blend product, the affinity of a dye for both component fibers and the internal diffusivity of the dye are important factors for the solid dyeing. Non-limitative examples of dyes having a desirable solid-dyeing property are C.I. Acid Yellow 19, C.I. Acid Yellow 61, C.I. Acid Yellow 42, C.I. Acid Yellow 110, C.I. Acid Orange 95, C.I. Acid Red 257, C.I. Acid Red 266, C.I. Acid Red 337, C.I. Acid Red 249, C.I. Acid Red 274, C.I. Acid Blue 129, C.I. Acid Blue 62, C.I. Acid Blue 78, C.I. Acid Blue 80, C.I. Acid Green 25, C.I. Acid Violet 48, C.I. Acid Yellow 207, and C.I. Acid Red 319.

The present invention is illustrated below in further detail with reference to Examples, but the invention is not limited thereto.

EXAMPLE 1

A solution of 0.11 g of C.I. Acid Blue 129, an acid dye, in a small volume of hot water was made up to 300 ml with water. To the solution, was added a solution of 0.5 g of salicylic acid in a small volume of ethyl alcohol to prepare a dyebath.

A dyeing material was prepared by blending a polypropylene (homopolymer; melt index, 10) and an ethylene-dimethylaminoethyl methacrylate (70/30 by weight) copolymer (melt index, 400) in a blending ratio of 93/7, pelletizing the blend, spinning at 250° C., drawing three-fold at 110° C., and spinning the resulting 15 denier filament to obtain a single yarn of 3 cotton counts (number of twist, 100 times/m).

Into the dyebath at 60° C., was dipped 10 g of the yarn. The dyebath temperature was raised to 100° C. over a period of 40 minutes with continued stirring. The temperature of the dyebath was held at 100° C. for additional 30 minutes with stirring to terminate the dyeing. The percentage of dye exhaustion at this stage was 99.7. The yarn was withdrawn from the dyebath, rinsed with water, and treated in a soaping bath at 60° C. for 5 minutes; the bath initially contained 2 g/liter of "Monogen" and the liquor ratio was 30/1. The yarn was finished by rinsing with water and drying.

The yarn was found to be dyed in deep blue color and showed good color fastness to light, the rating being 6 according to JIS L 0842; the ultimate percentage of fixed dye was 90.

For comparison, the above procedure was repeated, except that tartaric acid was used in place of the salicylic acid. The percentage of exhaustion and the ultimate percentage of fixed dye were as low as 62 and 49, respectively. The rating of color fastness to light was 4.

EXAMPLE 2

In hot water, was dissolved 0.11 g of an acid dye, C.I. Acid Blue 129. To the resulting solution, was added an emulsion prepared by kneading together 0.2 g of p-chlorobenzoic acid and 0.1 g of a nonionic surface active agent ("Noigen" EA 170) and adding thereto a small amount of water, and further water was added to the solution to make its amount 300 ml for use as dye bath.

A dyeing material was prepared by blending a polypropylene (homopolymer; melt index 15), ethylene-dimethylaminoethyl methacrylate copolymer (polymerization ratio 73/27 by weight, melt index 90) and sodium stearate in a blending ratio of 92/7/1, pelletizing the blend, melt-spinning at 260° C. and drawing 3.2 fold at 110° C. to obtain 17 denier filament.

Into the dye bath at 60° C., was dipped 10 g of the filament. The dye bath temperature was raised to 100° C. over a period of 40 minutes with continued stirring. The temperature of the dye bath was held at 100° C. for an additional 30 minutes with stirring to terminate the dyeing. The percentage of dye exhaustion at this stage was 99.8%. The filament was withdrawn from the dyebath, rinsed with water and treated in a soaping bath. Finally, the filament was finished by rinsing with water and drying.

The filament was found to be dyed in deep blue color and showed good color fastness to light. The ultimate percentage of fixed dye was 90%.

EXAMPLE 3

A solution of 2.2 g of C.I. Acid Blue 129, an acid dye, in a small volume of hot water was made up to 1,000 ml with water. To the solution was added 2.5 g of Indalca gum 7883 (a thickening agent supplied by Chugai Boeki Co.) followed by a solution of 5 g of salicylic acid in a small volume of ethyl alcohol. The mixture was stirred thoroughly to prepare a pad dyebath. A piece of tufted carpet fabricated by use of the spun yarn prepared as in Example 1 was dipped in the padding bath at room temperature, then wringed to a percentage liquor pick-up of 500, and steamed in a steamer at 100° C. for 10 minutes. Thereafter the dyeing material was rinsed with water, treated in a soaping bath containing 2 g/liter of "Monogen" at 60° C. for 5 minutes, rinsed with water, and dried. The finished carpet was found to have been dyed in deep blue and showed excellent color fastness to light, rating 5–6; the ultimate percentage of fixed dye was 84.

For comparison, the above procedure was repeated, except that tartaric acid was used in place of the salicylic acid. The finished carpet showed fair color fastness to light, rating 3; the percentage of fixed dye was only 45.

EXAMPLE 4

A solution of 2.8 g of C.I. Acid Red 249, an acid dye, in a small volume of hot water was made up to 1,000 ml with water. To the solution was added 2.5 g of Indalca gum 7883 (a thickening agent supplied by Chugai Boeki Co.) followed by a solution of 5 g of benzoic acid in a small volume of ethyl alcohol. The mixture was thoroughly stirred to prepare a padding dyebath. A piece of tufted carpet fabricated in the same way as in Example 3 was dipped in the padding bath at room temperature, wringed to a percentage liquor pick-up of 500 and steamed in a steamer at 100° C. for 10 minutes. Thereafter the material was rinsed with water, treated in a soaping bath, rinsed again with water, and dried. The finished carpet was found to have been dyed in deep red and showed excellent color fastness to wetting; the ultimate percentage of fixed dye was 77.

EXAMPLE 5

To a solution of 0.55 g of C.I. Acid Blue 129, an acid dye, in a small volume of hot water, were added 0.5 g of salicylic acid and 0.1 g of a nonionic surface active agent ("Noigen" EA 170), which had been kneaded together to form a uniform mixture, followed by 40 g of meypro gum NP (14% paste), a thickner. The mixture was made up to 100 g with water. The resulting color paste was thoroughly stirred to form a uniform printing color paste.

A tufted carpet, a dyeing material fabricated as in Example 3, was printed with the color paste through 70-mesh screen of plain gauze, then steamed in a steamer at 100° C. for 10 minutes, rinsed with water, treated in a soaping bath, rinsed with water, and dried. The printed polypropylene carpet was deep blue in color, showed neither bleeding of the dye from the printed area nor staining of the white ground, and the color fastness to light was excellent, rating 5; the ultimate percentage of fixed dye was 80.

For comparison, the procedure described above was repeated, except that tartaric acid was used in place of the salicylic acid. The finished carpet showed marked bleeding of the dye from the printed area in the steaming step and the staining of white ground was also marked. The percentage of fixed dye was only 40% and the color fastness to light was rating 3.

EXAMPLE 6

A solution of 0.11 g of C.I. Acid Blue 129, an acid dye, in a small volume of hot water was made up to 300 ml with water. To the solution heated at 60° C., was added a solution of 0.5 g of salicylic acid in a small volume of ethyl alcohol to prepare a dyebath.

A dyeing material was prepared by blending a polypropylene (homopolymer; melt index, 15), an ethylenedimethylaminoethyl methacrylate copolymer (copolymerization ratio, 73/27 by weight; melt index, 90), and sodium stearate in a blending ratio of 92/7/1 by weight, pelletizing the blend, melt spinning the pellets at 260° C., and drawing 3.2-fold at 110° C. to obtain 17 denier fiber.

Into the dyebath at 60° C., was dipped 10 g of the sample fiber. The temperature of the dyebath was raised with stirring to 100° C. over a period of 40 minutes. The temperature of the dyebath was held at 100° C. for additional 30 minutes with stirring to complete the dyeing. The percentage of dye exhaustion was 99.8. The fiber was removed from the bath, rinsed with water, treated in a soaping bath, again rinsed with water, and dried. The finished fiber was deep blue in color and showed excellent color fastness to light; the ultimate percentage of fixed dye was 93.

For comparison, the procedure described above was repeated, except that tartaric acid was used in place of salicylic acid. The percentage of dye exhaustion at the end of dyeing was 93 and the percentage of fixed dye at the end of finishing was 68. When acetic acid was used in place of the salicylic acid, the percentage of dye exhaustion at the end of dyeing was 94, while the percentage of fixed dye at the final stage was only 71%.

EXAMPLE 7

Into the same dyebath as in Example 6, was dipped 10 g of a 15 denier fiber obtained by blending a polypropylene and an ethylene-dimethylaminoethyl methacrylate copolymer, both being of the same compositions as those in Example 6, together with sodium benzoate in a blending ratio of 92/7/1 by weight, melt spinning the blend at 260° C., and drawing 3-fold at 110° C. The subsequent treatment was carried out in the same manner as in Example 6. The dyed fiber was deep blue in color. The percentage of dye exhaustion in the dyebath was 99 and the ultimate percentage of fixed dye was 91.

For comparison, the above procedure was repeated, except that acetic acid was used in place of the salicylic acid. The percentage of dye exhaustion in the dyebath was 92 and the ultimate percentage of fixed dye was 66%.

EXAMPLE 8

The procedure of Example 6 was repeated, except that the dyebath was prepared by dissolving 0.11 g of C.I. Acid Blue 129, an acid dye, in a small volume of hot water, diluting with water to make up the total to 300 ml, and adding to the solution 0.58 g of sodium salicylate and 0.57 g of phosphoric acid. The dyed material was deep blue in color. The percentage of dye exhaustion in dyebath was 99 and the ultimate percentage of fixed dye was 90.

For comparison, the same procedure was repeated, except that sodium salicylate was used in place of the acid mixture. The material could not be dyed. When the acid mixture was replaced by phosphoric acid alone, the percentage of dye exhaustion in dyebath was as high as 99%, while the ultimate percentage of fixed dye was only 79.

EXAMPLE 9

The procedure of Example 6 was repeated, except that 0.5 g of N,N-bis(2-hydroxyethyl)lauramide was added to the dyebath. The blue color of the dyed material was deeper as compared with the dyed material in Example 6. The percentage of dye exhaustion in dyebath was 99% and the ultimate percentage of fixed dye was 94.

EXAMPLE 10

A dyeing material was prepared by blending a polypropylene (homopolymer; melt index, 10), an ethylenedimethylaminoethyl methacrylate copolymer (copolymerization ratio, 70/30 by weight; melt index, 110), and sodium stearate in a blending ratio of 92/7/1 by weight, pelletizing the blend, spinning the pellets at 250° C. and drawing 3-fold at 110° C. into 6-denier filament, and then spinning a blend (50/50 by weight) of the resulting fiber and a 7-denier nylon-6 fiber spun from polycapramide, thereby to obtain a blended single yarn (6.5 cotton counts; number of twist, 100 times/m) of modified polypropylene and polyamide.

A dyebath was prepared by dissolving 0.11 g of C.I. Acid Blue 129, an acid dye, in a small volume of hot water, making up the resulting solution to 300 ml with water, adding a solution of 0.5 g of salicylic acid in a small volume of ethyl alcohol, and further adding 0.2 g of a formaldehyde condensate of sodium phenolsulfonate as the resist agent for the polyamide fiber. The pH of the resulting dyebath was 2.6. Into the dyebath held at 60° C., was dipped 10 g of the dyeing material and the temperature of dyebath was raised to 100° C. with stirring over a period of 40 minutes. The temperature was held at 100° C. for additional 30 minutes to complete the dyeing. The percentage of dye exhaustion at this stage was 99.9. The material was removed from the dyebath and finished by rinsed with water and drying. The dyed material was deep blue in color and showed uniformly dyed surface without specky appearance (phenomenon caused by the difference of dyeing depth and shade between modified polypropylene and nylon fibers). The color fastness was excellent to light (rating 6), wetting, and rubbing.

For reference, the same dyeing material as used above was dyed in 300 ml of a dyebath containing 0.11 g of the same C.I. Acid Blue 129 and 0.2 g of the same formaldehyde condensate of sodium phenol-sulfonate, a resist agent for the polyamide fiber as used above and some phosphoric acid to adjust pH to 2.6. The percentage of fixed dye on polypropylene fiber was markedly low and the dyed material showed specky appearance.

EXAMPLE 11

A solution of 0.1 g of C.I. Acid Yellow 110, an acid dye, was dissolved in a small volume of hot water and made up to 300 ml with water. To the solution were added, a dispersion prepared by kneading together 0.2 g of salicylic acid and 0.1 g of a nonionic surface active agent (Noigen EA 170) and admixing with a suitable volume of water, and, as the resist agent for the polyamide fiber, 0.2 g of a formaldehyde condensate of a mixture of bis-phenolsulfone and sodium naphthalenesulfonate. Into the resulting dyebath (pH 2.6) held at 60° C., was dipped 10 g of the dyeing material described in Example 10, which was a 50/50 blended yarn of modified polypropylene and nylon-6. While stirring, the dyebath temperature was raised to 100° C. over a period of 40 minutes. The stirring was continued for additional 30 minutes at 100° C. to complete the dyeing. The percentage of dye exhaustion at this stage was 100. The material was finished by rinsing with water and drying. The dyed material was deep yellow in color and showed uniform appearance without any difference in shade depth between both types of fiber. The color fastnesses to light, wetting and rubbing were excellent.

For reference, using the same dyeing material and dye as used above, the dyeing was carried out in a dyebath containing the same resist agent for the polyamide fiber as used above, some phosphoric acid to adjust pH to 2.6, and no other components. The shade depth on the polypropylene fiber was low and the solid dyeing was impossible.

EXAMPLE 12

A dyeing material was prepared in blending a polypropylene (homopolymer; melt index, 10) and an ethylene-dimethylaminoethyl methacrylate copolymer (copolymerization ratio, 70/30 by weight; melt index, 400) in a blending ratio of 93/7 by weight, pelletizing the blend, spinning the pellets at 250° C. and drawing 3-fold at 110° C. into 15-denier filament, and then spinning a blend (50/50 by weight) of the saie filament and a 7-denier nylon-66 (polyhexamethylene adipamide) filament into a blended single yarn (3 cotton counts; number of twist, 100 times/m) of modified polypropylene and polyamide.

A dyebath was preapred by dissolving 0.14 g of C.I. Acid Green 25, an acid dye, in a small volume of hot water, making up the resulting solution to 300 ml with water, adding 0.2 g of sodium salicylate and 0.3 g of a formaldehyde condensate of sodium phenolsulfonate as the resist agent for the polyamide fiber, and adjusting pH to 3.2 with 0.3 g of formic acid.

Into the dyebath held at 60° C., was dipped 10 g of the dyeing material and the dyebath temperature was raised to 100° C. with stirring over a period of 40 minutes. The temperature was held at 100° C. for additional 30 minutes to complete the dyeing. The percentage of dye exhaustion at this stage was 99.5. The material was removed from the dyebath and finished by rinsing with water and drying. The dyed material was deep green in color and showed even dyeing. The color fastness to light, wetting, and rubbing were excellent.

EXAMPLE 13

A blended single yarn (6.5 cotton counts; number of twist, 100 times/m) spun from a blend (50:50 by weight) of wool and the 6-denier modified polypropylene fiber described in Example 10 was used as the dyeing material A dyebath was prepared by dissolving in water 0.12 g of C.I. Acid Yellow 207, a metal complex dye, 0.3 g of sodium salicylate, and 0.2 g of a sodium phenolsulfonate-formaldehyde condensation product, then making up the resulting solution to 300 ml with water, and adjusting to pH 4 with formic acid.

Into the dyebath held at 50° C., was dipped 10 g of the dyeing material. While stirring, the dyebath temperature was elevated to 100° C. over a period of 50 minutes and held at 100° C. for additional 30 minutes to complete the dyeing. The percentage of dye exhaustion at this stage was 100. The yarn was removed from the bath and finished by rinsing with water and drying. The dyed material was deep yellow in color and showed even dyeing. The color fastness to light was excellent.

EXAMPLE 14

The blended yarn, described in Example 10, spun from a blend (50/50 by weight) of the modified polypropylene fiber and nylon-6 fiber was fabricated into a tufted carpet fabric.

A padding dyebath was prepared by dissolving 2.4 g of C.I. Acid Blue 62, an acid dye, in a small volume of hot water, making up the resulting solution to 1,000 ml with water, adding a solution of 5 g of salicylic acid in a small volume of ethyl alcohol, followed by 3 g of a phenolsulfonic acid-formaldehyde condensate, and thoroughly stirring. The pH of the dyebath was 2.5. The tufted carpet fabric was immersed in the padding dyebath at room temperature, wringed to a liquor pick-up of 500%, and steamed in a steamer at 100° C. for 30 minutes. Then, the carpet fabric was finished by rinsing with water and drying. The dyed carpet fabric was deep blue in color and showed even dyeing. The color fastness to light, wetting and rubbing were excellent.

EXAMPLE 15

A mixture was prepared by mixing a polypropylene (homopolymer; melt index, 10), an ethylene-dimethylaminoethyl methacrylate copolymer (copolymerization ratio, 70/30 by weight; melt index, 110) and sodium stearate in a mixing ratio of 92/7/1 by weight. The mixture was pelletized, spun at 250° C. and drawn 3-fold at 110° C. into 6-denier fiber from which a single yarn (cotton count 6.5; number of twist, 100 times/m) was spun. A polyamide single yarn (cotton count 7) was spun from 7-denier fiber of poly-(hexamethylene adipamide) (nylon 66). The polypropylene yarn and the polyamide yarn were alternately inserted by tufting into a primary base fabric of polypropylene to obtain a tufted carpet fabric (fabric weight, 800/m$^2$; 1/10 gage). A dyebath was prepared by dissolving 0.12 g of C.I. Acid Orange 95, an acid dye, in a small volume of hot water, making up the resulting solution to 300 ml with water, adding to the solution 0.4 g of sodium salicylate and 0.3 g of sodium butylnaphthalenesulfonate to dissolve therein, and adjusting the pH to 3.2 with 0.3 g of formic acid. Into the dyebath held at 60° C., 10 g of the tufted carpet fabric was dipped. While stirring, the dyebath temperature was raised to 100° C. over a period of 40 minutes and held at this temperature for 30 minutes to complete the dyeing. The percentage of dye exhaustion was 99.8 at this stage. The carpet fabric was removed from the dyebath and finished by rinsing with water and drying. The dyed carpet fabric was deep orange in color and substantially no difference in hue was detectable between the modified polypropylene yarn and the nylon 66 yarn. The fabric showed excellent color fastness to light, wetting, and rubbing.

EXAMPLE 16

In hot water, was dissolved 0.11 g of an acid dye, C.I. Acid Blue 129. A solution of 0.2 g of 5-chlorosalicylic acid in a small amount of ethyl alcohol was added thereto. The solution was made up to 300 ml with water to use as dye bath.

Then, the same dyeing material as used in Example 2 was dyes in the same manner as in Example 2.

The percentage of dye exhaustion at the dyeing stage was 99% and the ultimate percentage of fixed dye was 92%. The dyed material was found to be dyed in deep blue color and showed good color fastness to light.

What is claimed is:

1. A process for dyeing polyolefin fiber materials, which comprises contacting a polyolefin fiber material obtained by melt-spinning a mixture of crystalline polyolefin and 0.1 to 30% by weight based on the weight of the polyolefin of a copolymer of ethylene and an aminoalkyl acrylate compound represented by the formula

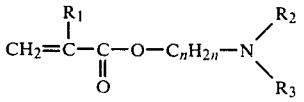

wherein $R_1$ represents hydrogen atom or methyl group, $R_2$ and $R_3$ each represents hydrogen atom or an alkyl group having 1 to 4 carbon atoms, and n represents an integer from 1 to 4, or a blend product of the said polyolefin fiber material and a polyamide fiber material, with a dye bath containing an anionic dye and at least one carboxylic acid selected from the group consisting of benzoic acid, salicylic acid, p-chlorobenzoic acid and 5-chlorosalicylic acid.

2. The process according to claim 1, wherein the amount of the carboxylic acid is 0.1 to 30% by weight based on the weight of the polyolefin fiber material or the blend product.

3. The process according to claim 1, wherein the carboxylic acid is produced in situ by adding an equivalent amount or more of an inorganic or organic acid to a solution of an alkali salt of the said carboxylic acid.

4. The process according to claim 1, wherein the blend product is contacted with a dye bath further containing a resist agent for the polyamide fiber at a pH of 5 or below.

5. The process according to claim 4, wherein the resist agent is a member selected from alkali metal or ammonium salts of benzenesulfonic acids and naphthalenesulfonic acids, condensation products of said sulfonic acids with formaldehyde, and condensation products of a mixture of bisphenolsulfone and alkali metal or ammonium salts of naphthalenesulfonic acids.

6. The process according to claim 4, wherein the amount of the resist agent is 0.1 to 20% by weight based on the weight of the blend product.

7. The process according to claim 1, wherein the contacting is carried out according to exhaustion dyeing, padding or printing method.

* * * * *